United States Patent [19]

Moore

[11] 4,352,078

[45] Sep. 28, 1982

[54] COMBINATION STATIC PLATE AND LIQUID DISTRIBUTION MANIFOLD FOR ELECTRICAL INDUCTIVE APPARATUS

[75] Inventor: Curtis L. Moore, Hermitage, Pa.

[73] Assignee: Electric Power Research Institute, Inc., Palo Alto, Calif.

[21] Appl. No.: 232,328

[22] Filed: Feb. 6, 1981

[51] Int. Cl.[3] ..... H01F 27/08

[52] U.S. Cl. ..... 336/60; 336/84 C; 336/197

[58] Field of Search ..... 336/55, 57, 58, 60, 336/62, 69, 70, 84 R, 84 C, 185, 197

[56] References Cited

U.S. PATENT DOCUMENTS

| | | | |
|---|---|---|---|
| 3,201,727 | 8/1965 | Narbut | 336/57 |
| 3,327,268 | 6/1967 | Rabus | 336/84 C |
| 3,376,530 | 4/1968 | Fischer | 336/84 C X |
| 3,675,175 | 7/1972 | Dutton | 336/84 C X |
| 4,129,845 | 12/1978 | Benke | 336/57 |
| 4,243,966 | 1/1981 | Degeneff et al. | 336/84 C X |

*Primary Examiner*—Thomas J. Kozma
*Attorney, Agent, or Firm*—L. P. Johns

[57] ABSTRACT

A static plate and liquid distribution manifold construction for vertical coils of electrical inductive apparatus, characterized by a plurality of vertically stacked pancake coils, manifold means comprising an inner rigid core of dielectric material, a coating of metal foil on the core, and a flexible bladder enclosing the rigid core and metal foil structure above the plurality of stacked coils, a plurality of radially spaced spacers between the coils and between the top coil and the manifold means, pressure means for compressing the assembly of the manifold means, the spacers, and the coils, an inlet means for introducing a coolant into the manifold bladder whereby the coolant fluid after leaving the manifold is fed by gravity downwardly over the several stacked coils.

10 Claims, 10 Drawing Figures

COMBINATION STATIC PLATE AND LIQUID DISTRIBUTION MANIFOLD FOR ELECTRICAL INDUCTIVE APPARATUS

BACKGROUND OF THE INVENTION

1. Field of the Invention

This invention relates to electrical distribution apparatus and, more specifically, to vaporization cooled electrical inductive apparatus.

2. Description of the Prior Art

Inductive apparatus utilizing gas insulation and vaporization cooling incur problems in properly distributing the liquid coolant, such as perfluorocyclic ether, over the high voltage and low voltage winding stacks for best cooling results. Examples of such apparatus are disclosed in U.S. Pat. Nos. 3,201,727; 4,129,845; and 4,243,966. A vapor cooled transformer, for example, requires liquid distribution and wetting of the coils with the source of the fluid ideally starting above a plurality of stacked pancake coils such as at the location of a static plate above the coils.

It has been found that with inductive apparatus, and particularly with transformers having higher voltages, it is necessary to make the windings for coils and other members with rounded or curved parts or corners thereby avoiding angular corners or sharp edges. The parts of the windings and other members that devoid of square corners and sharp edges by provided parts, avoid breakdown problems, particularly where gas/vapor coolants, manifolds or liquid distributors are provided.

SUMMARY OF THE INVENTION

In accordance with this invention, it has been found that problems inherent in two-phase fluid cooled inductive apparatus may be avoided by providing electrical inductive apparatus comprising a winding having a plurality of vertically stacked pancake coils; pressure means for applying compressive stress on the top of the coils; manifold means within the pressure means and adjacent to the top surface for distributing a dielectric fluid coolant over the coils; the manifold means comprising an inner rigid core of dielectric material, a coating of metal foil on the core, an insulating layer covering the foil-coated core, and an outer bag surrounding the core; inlet means for introducing the dielectric fluid coolant into the outer bag and including outlet means for draining the coolant from the bag and onto the coils; a plurality of radially spaced spacers between the coils and between the top coil and the pressure means, whereby the portions of the bag between the pressure means and the spacers are compressed against the core; the bag being flexible and distorted radially inwardly and outwardly of the core to provide coolant passages at the inner and outer peripheries of the core; the metal foil being electrically connected to the adjacent pancake coil; the underportion of the bag sagging between the spacers to provide coolant passage means; and the outlet means being disposed in the underportion.

Another embodiment of the invention consists of the foregoing structure which is devoid of the outer bag, but which provides instead internal duct means for conducting the coolant within the core, which means includes fluid inlet and outlet means, whereby the dielectric fluid coolant flows by gravity from the outer bag and over the several coils.

DESCRIPTION OF THE PREFERRED EMBODIMENTS

Figure 1:
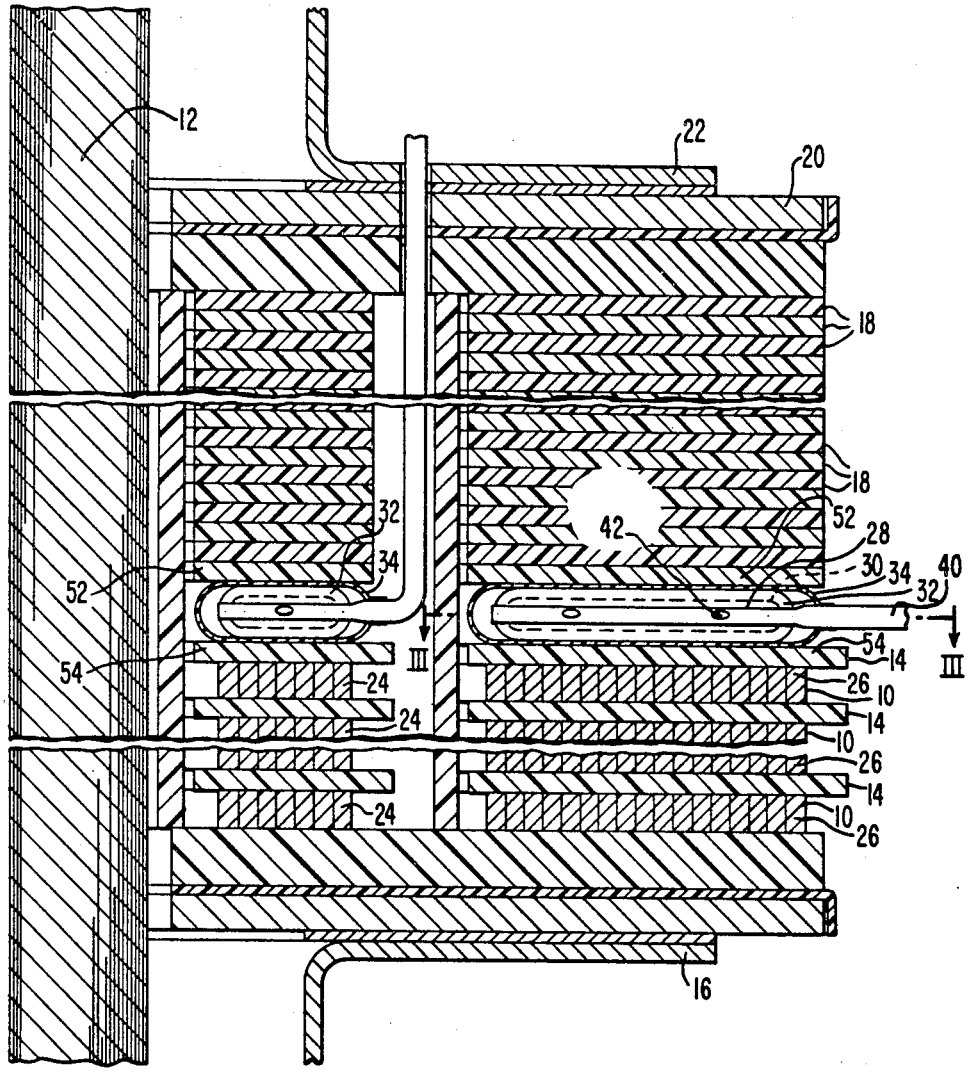
FIG. 1 is a vertical sectional view of a dielectric structure for high voltage gas insulated transformers taken on one side of a center line.

A dielectric structure for high voltage gas insulated transformers (FIG. 1) is comprised of a plurality of stacked pancake coils 10 which encircle a core 12. The stacked coils 10 are supported on insulative spacers 14 which are supported by an end frame 16. Above the coils 10 a plurality of radial spacers 18 are provided together with a pressure ring 20 which are supported under pressure by an upper end frame 22. The coils 10 are wound or connected into a high voltage coil 26. Likewise, adjacent pancakes 11 in the low voltage coil 24 are wound or connected to form a low voltage coil.

Figure 4:
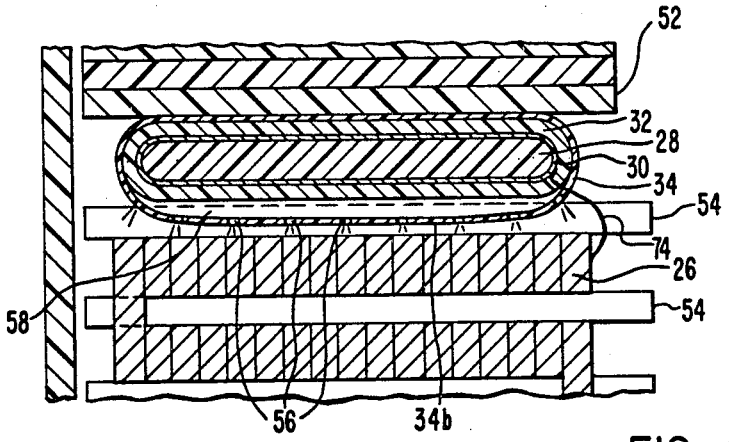
FIG. 4 is a vertical sectional view taken on the line IV—IV of FIG. 8.
Figure 5:
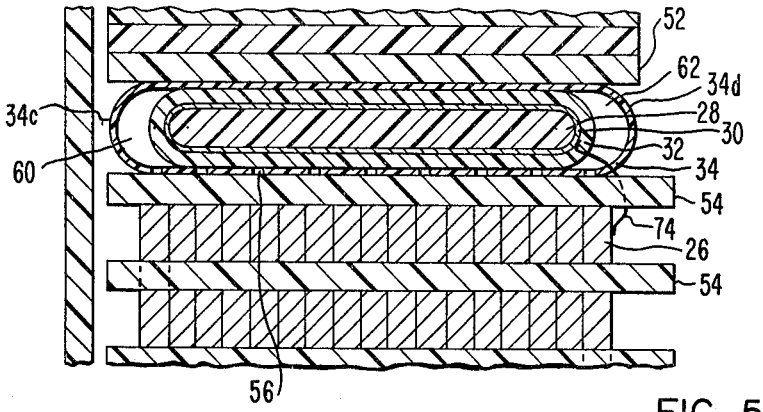
FIG. 5 is a vertical sectional view taken on the line V—V of FIG. 8.

Between the spacers 18 and the uppermost pancake of coils 24, 26, there is provided manifold means which comprises an inner rigid core 28 (FIGS. 4 and 5), a static plate 30, and insulating coating 32 and a bag 34. The core 28 and the coating 32 have rounded ends for corners to provide shielding and thereby avoid any breakdowns that occur in the higher voltage apparatus. The core 28 is comprised of pressed paperboard laminates, such as Micarta, which is dielectric. The static plate 30 is a metal foil enclosing the core 28 including upper and lower surfaces as well as opposite rounded ends thereof.

Figure 2:
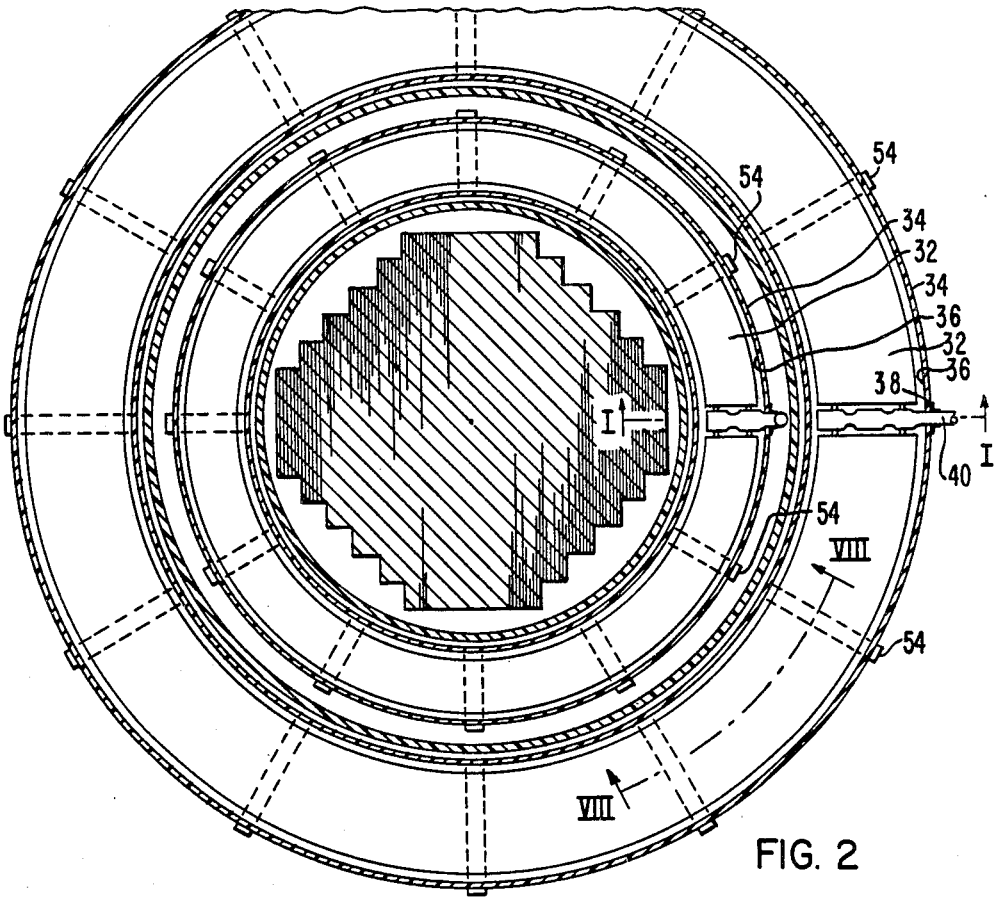
FIG. 2 is a horizontal sectional view through the core coil assembly around a center line.

The insulating coating 32 is likewise composed of a dielectric material, such as aramid paper or creped paper, and completely encloses the assembly of the core and static plate. The assembly of the core 28, static plate 30, and insulating coating 32 is rigid and continuous except for a gap 36 (FIG. 2). The assembly is completely enclosed with a bladder-like flexible bag 34. The bag 34 is a continuous tubular member comprised of a flexible material, such as elastomer or any other material that is compatible with the liquid coolant. Being flexible, the bag conforms to any forces applied to it either internally or externally, and thereby serves as a highly satisfactorily means for distributing the dielectric coolant over the stacked pancake coils from which the coolant flows by gravity as set forth below.

Figure 3:
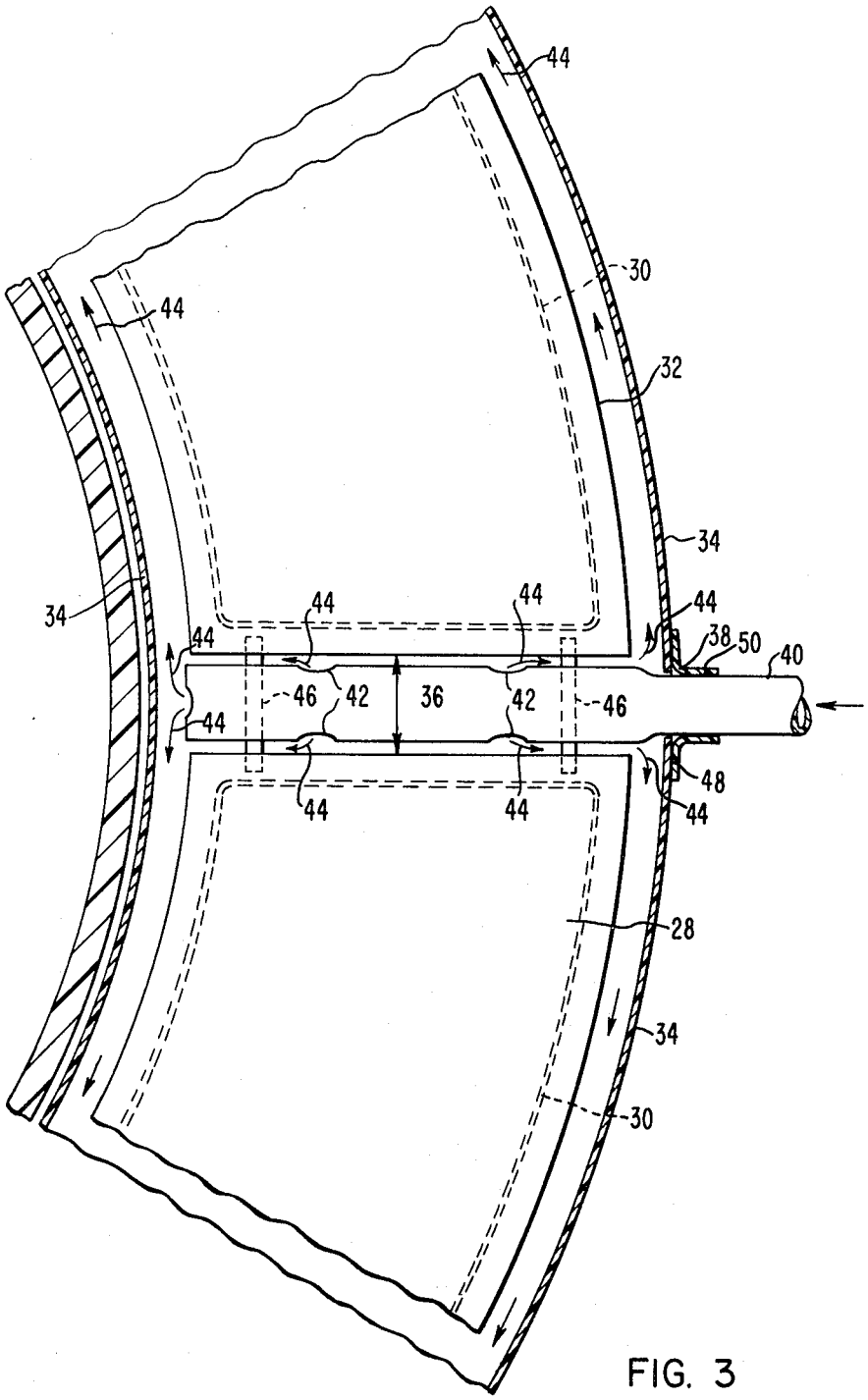
FIG. 3 is an enlarged fragmentary sectional view taken on the line III—III of FIG. 1.

The bag 34 includes a fluid inlet opening 38 (FIGS. 2, 3) which is an out-turned tubular portion integral with the bag and adapted to receive inlet means, such as an inlet tube 40. The tube 40 is connected to a source of a dielectric fluid coolant, such as a fluorocarbon, or perchloroethylene. The inner end portion of the tube 40 extends into the gap 36 between opposite ends of the coating 32 and the end portion is provided for a plurality of openings 42 through which the coolant passes into the gap 36 and from there into unoccupied portions of the bag 34 as indicated by fluid arrows 44. A pair of pins 46 (FIG. 3) extend through the inner end portion of the inlet tube 40, through the gap 36 into opposite ends of the coating 32 to secure the tube in place. Liquid-tight connections including bonds 48, 50 are provided between the fluid inlet opening 38, the bag 34, and the tube 40.

Figure 8:
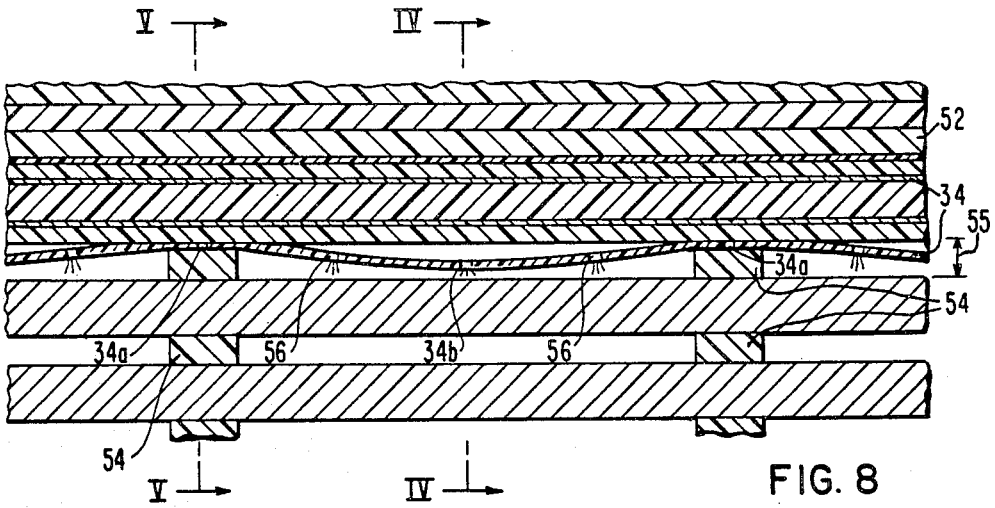
FIG. 8 is a vertical sectional view taken on the line VIII—VIII of FIG. 2.

As shown in FIG. 1, the construction including the core 28, static plate 30, coating 32, and flexible bag 34 is disposed between radial spacers 52, 54 on the upper and lower sides thereof. As shown more particularly in FIG. 2, the spacers 52, 54, of which only spacers 54 are shown, are disposed radially about the winding or coils 24, 26 to maintain a space 55 (FIG. 8). The radial spacers 54 maintain the space 55 not only between the successive layers of coils 24, 26, as well as between the coils and the manifold structure provided by the assembly of the core 28, static plate 30, coating 33, and bag 34. Accordingly, at the locations of the several spacers 54, the bag 34 is held against the undersurface of the manifold assembly at **34*a* (FIG. 8) while the bag sags at 34*b* between the spacers 54. At the locations of the portions of the bag 34*b* between the spacers 54, the bag is provided with fluid outlet means 56 (FIGS. 4, 5 and 8), which may comprise either openings in the bag 34 or spray nozzles in such openings to facilitate flow of the fluid from the bag unto the upper surface of the coils 24, 26. Thus, the fluid flows from the bag 34** by gravity unto, over and through the surfaces of the coils beginning at the upper end and downwardly to the lowermost coils.

Where the portions **34*b* of the bag sag between the spacers 54 (FIG. 4), the bag provides a conduit space 58 between the bag and the undersurface of the coating 32 through which space the fluid is conducted to the outlet means 56. Correspondingly, where the bag is confined between the radial spacers 54 (FIG. 5), the flexible bag bulges radially inwardly and outwardly at 34*c*, 34*d* to provide conduit spaces 60, 62, which spaces communicate with the conduit spaces 58 where the bag sags at 34*b*. Thus, the flexible bag 34 serves as a conduit for the dielectric cooling fluid from the fluid-inlet point of the inlet tube 40 to the several outlet means 56 around the periphery of the windings or coil structures (FIG. 2**), thereby facilitating distribution of the liquid during operation of the transformer.

Figure 6:
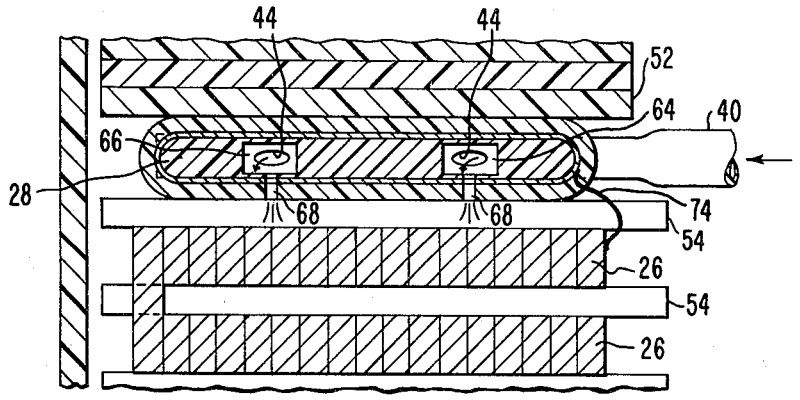
FIG. 6 is a vertical sectional view of another embodiment similar to that of FIG. 4 without the bag.
Figure 7:
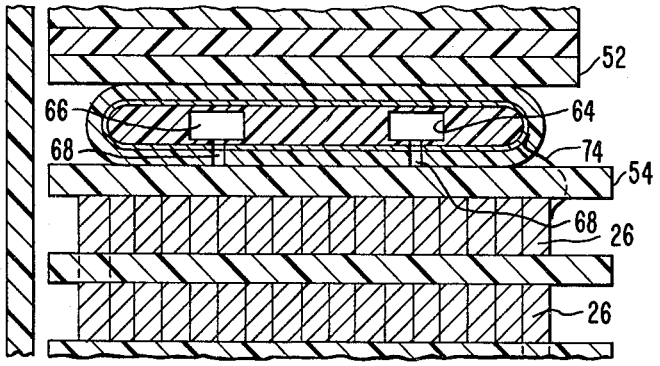
FIG. 7 is a vertical sectional view similar to that of FIG. 5 without the bag.

Another embodiment of the invention is that shown in FIGS. 6 and 7 in which similar numbers refer to similar parts as set forth above. In this embodiment, the manifold assembly does not include a flexible bag 34 as shown in the prior embodiment. Instead, a pair of fluid ducts 64 and 66 are concentrically disposed within the inner rigid core 28 and are provided with fluid outlet means 68 in a manner similar to the outlet means 56. Ducts 64, 66 are provided with fluid inlet means such as conduits 70, 72. In all other respects, this embodiment is similar to that of the prior embodiment with flow means provided for delivering and distributing a dielectric flow path including the ducts 64 and 66, and fluid outlet means 68. In FIG. 6 the fluid outlet means 68 are disposed between the radial spacers 54 corresponding to the position of the embodiment shown in FIG. 4. However, where the fluid outlet means 68 are disposed above a radial spacer 54 (FIG. 7), they are blocked and thereby prevent passage of the dielectric fluid from the ducts 64, 66 in a manner similar to embodiment of FIG. 5.

Figure 9:
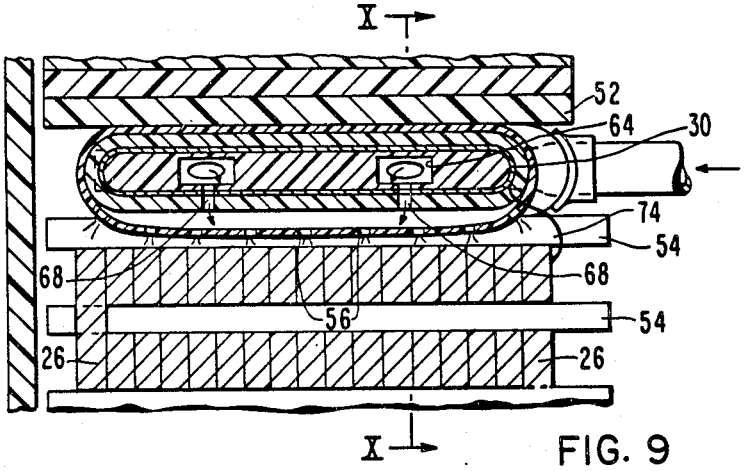
FIG. 9 is a vertical sectional view showing another embodiment that includes the structures of FIGS. 4 and 6.
Figure 10:
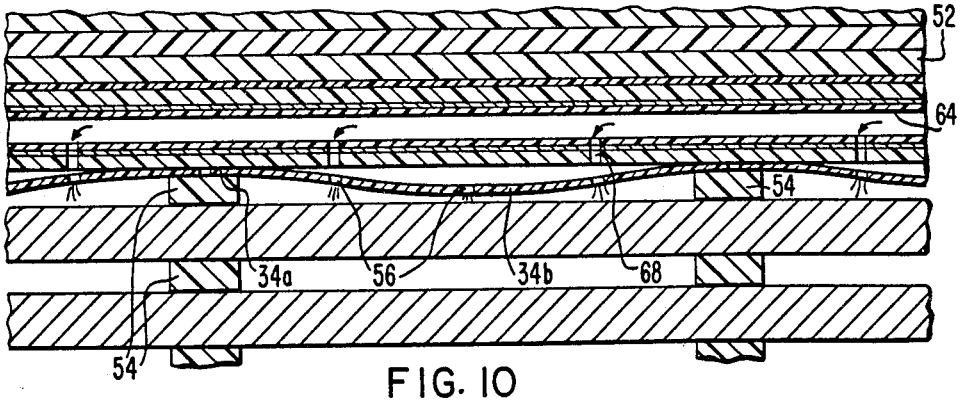
FIG. 10 is a vertical sectional view of another embodiment similar to FIG. 9 showing both bag and ducts.

In another embodiment of the invention, as shown in FIGS. 9 and 10, similar numerals refer to similar parts set forth above. This embodiment includes the structures of both embodiments set forth above, whereby the manifold means include the flexible bag 34 as well as the ducts 64, 66 with associated outlet means 68. The fluid outlet means 68 deliver dielectric fluid from the ducts to the inner bag from where it flows through outlet means 56 to the top of the coils 24, 26 in the manner set forth above.

In all of the embodiments of this invention, the static shield or plates 30 are electrically connected with one of the coils, such as coil 26, by a conductor 74. Moreover, in each embodiment the successive layers of high voltage pancake coils 26 are interconnected by a conductor 76 and the low voltage coils 24 are interconnected by a conductor 78 in a conventional manner.

Accordingly, the advantages of the device of this invention comprise shielding to the ground, liquid distribution, insulation, capacitance, and mechanical support of the coils. The primary principle involved is to form a shield by insulating the static plate and core by containing the core in an oversized tubular element that is perforated at desired locations to wet the top and subsequent sections of the windings. The space between the loose fitting tubular bag and the insulated core is used to help distribute the liquid around the coil. If necessary, further manifolding or distribution is accomplished by using internal ducts within the core of the static plate.

The presence of the dielectric coolant improves the dielectric capability as well as the capacitance between the static plate and the end section. The dielectric constant of the liquid is 2.3 instead of one as for a gas. Finally, the combination of the static plate and the manifold together with any vertical pancake-type coil provides a method of delivery of liquid to the desired place, but also uses the liquid to improve the insulation and capacitance between the static plate and the first or end section.

What is claimed is:

1. An electrical inductive apparatus comprising:

a winding;

pressure means for applying compressive stress on the top surface of the winding;

manifold means within the pressure means and adjacent to the top surface for distributing a dielectric fluid coolant by gravity flow over the winding;

the manifold means comprising an inner rigid core of dielectric material, a coating of metal foil on the core, and an outer member surrounding the foil-coated core and providing fluid-conducting passage means with the core and the coating;

inlet means for introducing the dielectric fluid coolant into the fluid-conducting passage means and including outlet means for draining the coolant from the passage means and onto the winding; and the metal foil serving as an electrostatic shield for and electrically connected to the winding.

2. The apparatus of claim 1 in which an insulating layer covers the foil-coated core.

3. The apparatus of claim 1 in which the dielectric fluid coolant flows by gravity from the passage means and over the winding.

4. The apparatus of claim 2 in which the winding is comprised of a plurality of vertically stacked pancake coils, a plurality of radially spaced spacers between the coils and between the top coil and the pressure means, the fluid-conducting passage means including an outer bag surrounding the insulating layer, whereby the portions of the bag between the pressure means and the spacers are pressed against the static plate core, the bag being flexible and distorted radially inwardly and outwardly to provide coolant passages at the inner and outer peripheries of the core, and the metal foil being electrically connected to the adjacent pancake coil.

5. The apparatus of claim 4 in which the underportion of the bag sags between the spacers to provide coolant passage means, and the outlet means being disposed in the underportion.

6. The apparatus of claim 1 in which the fluid-conducting passage means comprises internal duct means within the core for conducting said coolant, which duct means communicate with the inlet means and with the outlet means.

7. The apparatus of claim 6 in which the core includes internal duct means for conducting the coolant to the top surface of the winding.

8. An electrical inductive apparatus comprising:

a winding;

pressure means for applying compressive stress on the top surface of the winding;

manifold means within the pressure means and adjacent to the top surface for distributing a dielectric fluid coolant by gravity flow over the winding;

the manifold means comprising an inner rigid core of dielectric material, and a coating of metal foil on the core, and serving as an electrostatic shield for and electrically connected to the winding;

the core having internal duct means for conducting said coolant;

inlet means for introducing said coolant to the internal duct means; and the internal duct means having outlet means for distributing said coolant by gravity over the winding.

9. The apparatus of claim 8 in which the core-foil assembly is enclosed within an insulating coating, and the outlet means extends from the internal duct means and through the insulating coating.

10. The apparatus of claim 9 the assembly of the core-foil assembly and insulating coating is enclosed within an outer bag having outlet means for draining the coolant from the internal duct means and onto the windings.

* * * * *